US006290351B1

(12) United States Patent
Merz

(10) Patent No.: US 6,290,351 B1
(45) Date of Patent: Sep. 18, 2001

(54) PRINTER HAVING PRECISION SHEET TRANSPORT CONTROL METHOD AND APPARATUS

(75) Inventor: Eric A. Merz, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/431,951

(22) Filed: Nov. 1, 1999

(51) Int. Cl.[7] ..... B41J 2/01
(52) U.S. Cl. ..... 347/104; 400/579; 400/582
(58) Field of Search ..... 400/579, 581, 400/582, 631; 347/104

(56) References Cited

U.S. PATENT DOCUMENTS

| | | | | |
|---|---|---|---|---|
| 5,260,725 | * | 11/1993 | Hammond | 346/157 |
| 5,272,493 | * | 12/1993 | Hubble, III et al. | 346/160 |
| 5,947,617 | * | 9/1999 | Kondo | 400/579 |
| 6,059,285 | * | 5/2000 | Suga et al. | 271/228 |
| 6,106,090 | * | 8/2000 | Uchida et al. | 347/8 |

* cited by examiner

*Primary Examiner*—John S. Hilten
*Assistant Examiner*—Marvin P Crenshaw
(74) *Attorney, Agent, or Firm*—Tallam I. Nguti

(57) ABSTRACT

A printer and a method for producing precise registered images are provided. The method in the printer is carried out by an included sheet transport and control assembly for moving a sheet of paper along a sheet path through a printing zone. The sheet transport and control assembly includes drive device; a moveable sheet carrying web member having a first edge and a second edge having an array of precision holes, including adjacent holes spaced a precise distance apart, formed through at least the first edge and the second edge. The sheet transport and control assembly also includes a programmable controller connected to the drive device, and a dual sensor assembly mounted along the sheet path and connected to the programmable controller for responsively generating and inputting precision hole position signals to the programmable controller. The dual sensor assembly includes a first sensor for generating a first increasing and decreasing signal, and a second sensor for generating a second increasing and decreasing signal that increases and decreases oppositely relative to the first signal. The programmable controller controls the moving device to move and stop the web member responsively to a desired value of a ratio of the first signal to the second signal, thereby ensuring precise moving and stopping of a sheet of paper on the web member through the printing zone.

5 Claims, 3 Drawing Sheets

PRINTER HAVING PRECISION SHEET TRANSPORT CONTROL METHOD AND APPARATUS

BACKGROUND OF THE INVENTION

The present invention relates generally to printers such as ink jet printers, and more particularly to such a printer including a precision sheet transport control method and apparatus for minimizing printed image misregistration and other observable printed image defects.

An ink jet printer of the type frequently referred to as drop-on-demand, has at least one printhead from which droplets of ink are directed towards a recording medium. Within the printhead, the ink is contained in a plurality of channels. Piezoelectric devices or power pulses cause the droplets of ink to be expelled as required, from orifices or nozzles located at the end of the channels. In thermal ink jet printing, the power pulses are usually produced by resistors also known as heaters, each located in a respective one of the channels. The heaters are individually addressable to heat and vaporize the ink in the channels. As a voltage is applied across a selected heater, a vapor bubble grows in that particular channel and ink bulges from the channel nozzle. At that stage, the bubble begins to collapse. The ink within the channel retracts and then separates from the bulging ink thereby forming a droplet moving in a direction away from the channel nozzle and towards the recording medium whereupon hitting the recording medium a spot is formed. The channel is then refilled by capillary action which, in turn, draws ink from a supply container of liquid ink.

The ink jet printhead may be incorporated into either a carriage type printer or a page width type printer. The carriage type printer typically has a relatively small printhead containing the ink channels and nozzles. The printhead is usually sealingly attached to a disposable ink supply cartridge and the combined printhead and cartridge assembly is attached to a carriage which is reciprocated to print one swath of information (equal to the length of a column of nozzles) at a time on a stationary recording medium, such as a sheet of paper or a transparency.

After each such swath is printed, the sheet of paper is transported or advanced forwardly (usually the movement involves stepping or indexing) a distance that is equal to the height of the printed swath or of a portion thereof so that the next printed swath is properly registered in an overlapping or contiguous manner therewith. The procedure is then repeated until an entire page on the sheet is printed.

Conventional sheet transporting or advancing systems in such printers typically have limited precision due to the limited precision of the mechanical components that make up the system. The predictable and inescapable result of such limited precision is image misregistration. It has been found that when printed material includes misregistration defects of even one-half pixel, such defects will be observable. This is becoming more and more of a problem as the printing industry pushes for lower and lower cost printers with finer and finer levels of pixel resolution, (which has now reached and is exceeding 600 dpi). The reason a one-half pixel misregistration defect is observable is because at 600 dpi a one-half pixel error is equal to about 21 microns.

SUMMARY OF THE INVENTION

In accordance with one aspect of the present invention, there is provided a printer for producing precise registered images is provided and includes a sheet transport and control assembly for moving a sheet of paper along a sheet path through a printing zone. The sheet transport and control assembly includes drive device; a moveable sheet carrying web member having a first edge and a second edge having an array of precision holes, including adjacent holes spaced a precise distance apart, formed through at least the first edge and the second edge. The sheet transport and control assembly also includes a programmable controller connected to the drive device, and a dual sensor assembly mounted along the sheet path and connected to the programmable controller for responsively generating and inputting precision hole position signals to the programmable controller. The dual sensor assembly includes a first sensor for generating a first increasing and decreasing signal, and a second sensor for generating a second increasing and decreasing signal that increases and decreases oppositely relative to the first signal. The programmable controller controls the moving device to move and stop the web member responsively to a desired value of a ratio of the first signal to the second signal, thereby ensuring precise moving and stopping of a sheet of paper on the web member through the printing zone.

Pursuant to another aspect of the invention, there is provided a method of transporting and controlling a sheet for precise image printing through a printing zone of a printing machine. The method includes the steps of mounting within the printing machine a moveable web assembly including a drive device, and an endless sheet carrying web member having a constant path of movement through the printing zone, and a series of holes formed at desired locations along at least one edge thereof; attaching a sheet for image printing onto the web member; and mounting a first sensor, and a second sensor along constant path of movement, for respectively producing a first signal that increases and decreases, and a second signal that increases and decreases oppositely relative to the first signal. The method then includes the steps of connecting a programmable controller to the drive device and to the first and second sets of sensors; and moving and stopping the web member through the printing zone responsively to a desired ratio of the second signal to the first signal, thereby minimizing misregistration and other observable printed image defects in printed images.

BRIEF DESCRIPTION OF THE DRAWINGS

In the detailed description of the drawings presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
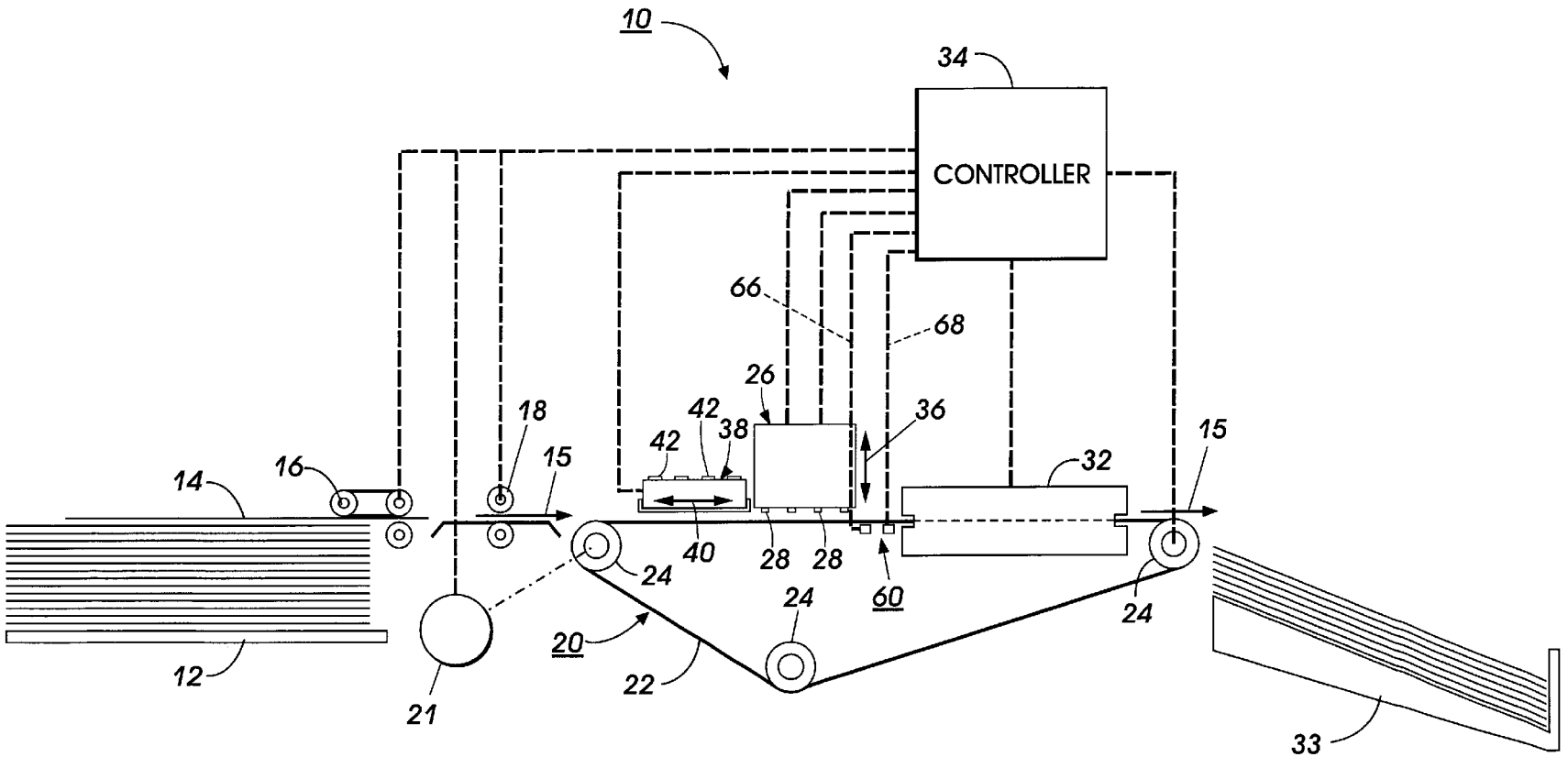
FIG. 1 is a schematic elevational view of an ink jet printer incorporating the sheet indexing control system of the present invention.

FIG. 1 illustrates a schematic elevational view of a liquid ink printer 10, for instance, an ink jet printer, of the present invention. The liquid ink printer 10 includes an input tray 12 containing sheets of a recording medium 14 to be printed upon by the printer 10. Single sheets of a recording medium 14 (such as sheets of paper) are removed from an input tray 12 by a pickup assembly 16 and fed by feed rollers 18 to a sheet transport and control assembly 20. As illustrated generally, the sheet transport and control assembly 20 includes a web or belt 22 of the present invention that is driven by a drive device 21, such as a stepper motor, via rollers 24, and controlled by a controller 34 in accordance with the present invention (to be described in detail below). As driven and controlled, the sheet transport and control assembly 20 is suitable for precisely indexing and moving the sheet 14 along a sheet fixed and constant path 15 (indicated as an arrow 15) past a liquid ink printhead assembly 26.

As is well known, the printhead assembly 26 includes one or more printhead units 28 supported in a printing position by a printhead carriage (not shown) for moving the printhead assembly 26 back and forth in a direction which is normal to the sheet indexing direction or path 15 (i.e. a direction that is in and out of the page as shown). As summarized in the background section above, each printhead is sealingly attached to an ink supply and to a carriage, and reciprocated back and forth as above to print one swath of information (equal to the length of a column of nozzles of the printhead) at a time on the recording medium while the recording medium or sheet of paper is stationary.

After the swath is printed, the sheet of paper is stepped or indexed forwardly, in accordance with the present invention, a distance that is equal to the height of the printed swath or to a portion thereof so that the next swath printed is precisely registered in an overlapping or contiguous manner therewith. The procedure is then repeated until an entire page on the sheet is printed. The complete or fully printed sheet may be moved through a dryer 32, for example, and into an output tray 33.

The programmable controller 34 controls the operation of the sheet transport and control assembly 20, the movement of the printhead assembly 26, printing by the printheads 28, and operation of the dryer 32, as would be understood by one skilled in the art. The programmable controller 34 can also include a plurality of individual programmable controllers, such as microprocessors or other known devices dedicated to perform a particular function.

At the completion of a printing operation or when otherwise necessary, such as during a power failure, the printbar assembly 26, which is movable in the directions of an arrow 36, is moved away from the belt 22 such that a capping assembly 38, movable in the directions of the arrow 40, is moved beneath the printbar assembly 26 for capping thereof. It is understood the printhead assembly 26 may equally be moved to the side of the print zone and there capped onto a stationary capping assembly 38. Once the cap assembly 38 is positioned directly beneath the printbar assembly 26, the printbar assembly 26 is moved towards the belt 22 and into contact with a plurality of capping gaskets 42 located on the cap assembly 38.

The cap assembly 38 includes one or more of the capping gaskets 42 which engage or contact the page width printbars on an area surrounding one or more of the printbars to thereby seal the printbar nozzles from exposure to air. The substantially airtight seal of the capping assembly 38 prevents the ink contained in the nozzles from drying out to thereby prevent clogging of the individual printbar nozzles. Once a capping operation is complete, the printbar assembly 26 moves away from the belt 22 and the capping assembly 38 moves away from the printbar assembly 26 such that the printbar assembly 26 can be repositioned appropriately with respect to the belt 22 for printing on a recording sheet 14.

Figure 2:
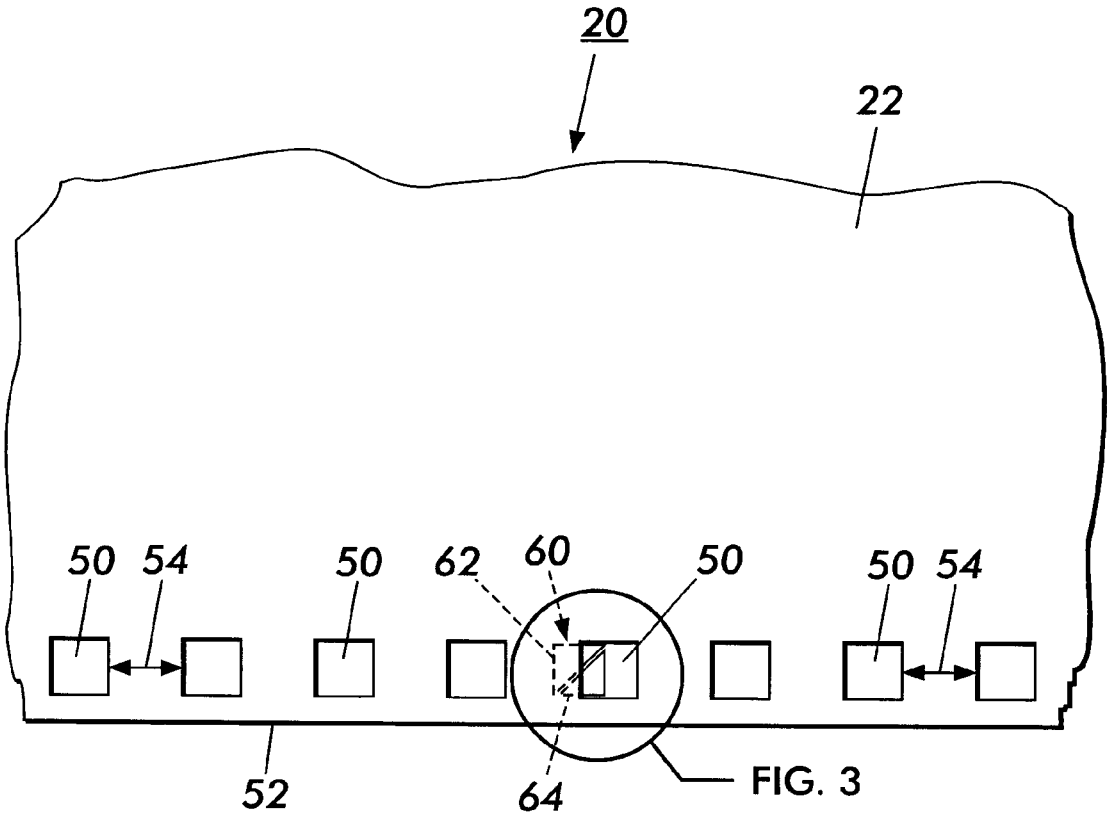
FIG. 2 is a schematic plan view of a portion of the indexing web showing the precision holes and dual sensors of the control system of FIG. 1.
Figure 3:
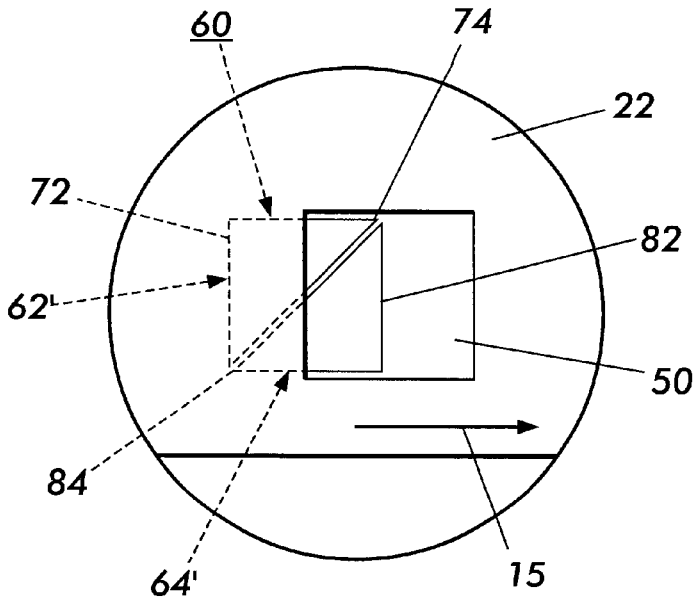
FIG. 3 is a schematic of one arrangement of the dual sensors of control system of the present invention.
Figure 4:
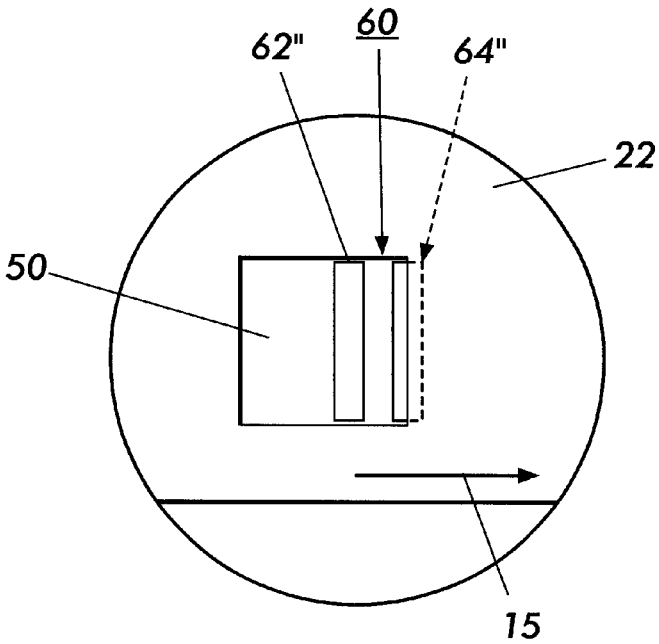
FIG. 4 is a schematic of another arrangement of the dual sensors of control system of the present invention.

In accordance with the present invention, the sheet of paper or recording medium 14 is tacked to the belt or belt or web member 22 for example by means of vacuum or other suitable means such as electrostatically, adhesively, or mechanically using grippers. As shown in FIGS. 2–4, the belt or web member 22 of the sheet transport and control assembly 20, has precise holes 50 along at least one 52 of its wedges, and preferably along both edges (second edge not shown). Preferably, the precision holes 50 can be punched or etched in the belt or web 22 to tolerances within 5 microns (FIGS. 2–4 not to scale), such as have been used in the motion picture industry to register each frame of film in a projector.

The sheet transport and control assembly 20 importantly includes a dual sensor assembly 60, including a first photodiode sensor 62, and a second photodiode sensor 62, are mounted along the sheet constant path 15 of movement of the belt or web member 22. The first and second sensors 62, 64 are connected to the programmable controller 34, and respectively produce first and second signals 66, 68 (FIG. 1), preferably voltage signals, that are used by the programmable controller 34 for moving and stopping the belt or web member 22, and hence the sheet 14 tacked to it.

Referring to FIGS. 2–4, as the web member 22 moves over each sensor 62, 64, each hole 50 first exposes more and more of the surface area of each sensor and then less and less of such area as a non-hole area 54 of the edge of the belt then moves over the same sensor. The sensors 62, 64 are such that the voltage of each sensor is proportional to that portion of the surface area of the sensor that is exposed by a passing hole 50 over such sensor. As such, with each hole 50 passing over a sensor 62, 64, the signal produced first increases, and then decreases.

In general, the dual sensor assembly 60 is connected to the programmable controller 34 for responsively generating and inputting precision hole position signals to the programmable controller 34 for controlling moving and stopping of the belt or web member 22. In accordance with the present invention, the programmable controller 34 is suitable for calculating a signal ratio of the second signal to the first signal, and for moving and stopping the drive device 21, and the web member in responsive to a desired value of such signal ratio. In this manner, forward motion of the belt or web member 22, and sheet 14 tacked thereto, can be controlled precisely, thereby minimizing misregistration and other observable printed image defects in printed images.

In other words, the sheet transport and control assembly 20 includes the programmable controller 34 which is connected to the drive device 21, and to the dual sensor assembly 60. The dual sensor assembly 60 is mounted along the sheet path 15, and connected to the programmable controller 34, for responsively generating and inputting precision hole position signals to the programmable controller. The dual sensor assembly 60 as shown (FIGS. 2–4) includes a first sensor 62 for generating a first increasing and decreasing signal 66, and a second sensor 64 for generating a second increasing and decreasing signal 68.

Importantly in accordance with the present invention, the first and second sensors 62, 64 are arranged such that the second signal increases and decreases oppositely relative to the first signal. As the hole 50 in the edge 52 of the web member 22 moves across the dual sensor assembly 60, the voltage signal will progressively change from 100% for first sensor 62, and 0% for the second sensor 64, to 0% for first sensor 62 and 100% for the second sensor 64. The drive device or stepper motor 21, is then driven to "creep up" onto a position and stop exactly at the point where the first and second voltage signals have a desired ratio, for example a ratio of 1 where the two signals are equal. This will enable the stop position of the web member to be precisely controlled.

The programmable controller 34 is programmed to continuously calculate a ratio of the second signal to the first signal, and to then control the drive device 21 to move and stop the web member 22 and sheet 14, responsively to a desired value of such ratio. The dual sensor assembly 60 thus effectively zeroes out any effects of sensor contamination which can change voltage signal level readings, and thereby ensures precise moving and stopping of a sheet of paper 14 on the belt or web member 22 through the printing zone. Furthermore, by using a dual photodiode system, this invention circumvents problems associated with using a sensor in a system that is susceptible to temperature, lighting and contamination variation. One sensor can act as a reference and the system can compensate for changes by looking at a comparison between two photodiode outputs.

Referring in particular to FIGS. 2–3, a first embodiment of the dual sensor assembly 60 of the present invention is illustrated and comprises a first and a second photodiode sensor 62', 64' each having a triangular shaped surface area as shown. Importantly, the first and second triangular shaped sensors 62', 64' are identical in shape and performance, and are arranged appositely (as shown in FIG. 3) so that as a hole 50 moves (left to right for example) across both sensors 62', 64', the base 72 representing a large surface area of the first sensor 62' is first available through the hole 50. The base 72 is then followed by a smaller and smaller surface area thereof, as the hole moves to the apex 74 of the first sensor 62'. At the same time, the apex 84 representing a small surface area of the second sensor 64' is first available through the same hole 50, followed by a larger and larger surface area thereof, as the hole moves to the base 82 of the second sensor 64'.

Since the first signal 66, and the second signal 68, produced respectively by these sensors, 62', 64' are proportional to each portion of the surface area of each sensor that is exposed through each hole 50, the second signal 68 therefore will increase and decrease oppositely relative to the first signal 66. The programmable controller 34 for example, can then be programmed to start decelerating the web member 22 as the values of the first and second signals 66, 68 approach one another, or as their ratio being calculated approaches one or unity.

Referring in particular to FIG. 4, a second embodiment of the dual sensor assembly 60 of the present invention is illustrated and comprises a first and a second photodiode sensor 62", 64", respectively, each having a rectangular shaped surface area as shown. Importantly, the first and second rectangular shaped sensors 62", 64" are identical in shape and performance, and are arranged (as shown in FIG. 4) so as to mark the start of deceleration and a stop point in the forward movement (left to right) of the belt or web member 22. For example, the controller 34 can be programmed to start deceleration after the surface area and hence signal from first sensor 62", reaches a maximum value (because of being fully exposed), and to stop the web member 22 when the surface area and hence the second signal reaches a desired percentage, for example, 50% of the first area, hence 50% of the first signal. In other words, the web member 22 is moved at a normal speed until a hole 50 fully exposes the first photodiode sensor 62". At such time, the speed of the web member 22 can be reduced so that that hole 50 can slowly approach the second sensor 64". The web member 22 is then advanced at a creeping speed, for example until the voltage signal from the second sensor 64" for example, is equal to one-half the voltage signal from the first sensor 62".

The method of transporting and controlling a sheet in accordance with the present invention for precise image printing through a printing zone of a printing machine therefore includes the steps of mounting to a frame of the printing machine a moveable web assembly including a drive device 21, and an endless sheet carrying belt or web member 22 having a constant path 15 of movement through the printing zone of the printing machine. The sheet carrying belt or web member 22 has a series of holes 50 formed at desired locations along at least one edge 52, thereof.

The method then includes attaching a sheet 14 for image printing onto the web member, mounting a first set and a second set of signal producing sensors 62, 64 along the constant path 15 of movement for producing a first signal and a second signal, respectively, connecting a programmable controller 34 to the drive device 21 of the web member and to the first and the second signal producing sensors 62, 64 for processing the first and second signals 66, 68, and moving and stopping the belt or web member 22 through the printing zone of the printing machine responsively to a desired ratio of the second signal to the first signal. This ensures precise moving and stopping of the sheet of paper 14 on the belt or web member 22 through the printing zone and thus minimizes misregistration and other observable printed image defects in printed images.

To recap, the present invention describes a method to create precise positioning in a belt drive system using a dual photodiode system for sensing and controlling the motion of a belt or web. Specifically, this invention can be applied to a "scan and advance" printing machine, such as ink jet printers. The invention enables the use of low cost, low tolerance components to be used to perform mechanical movements, and thus will significantly reduce the tolerance stackup in the printing machine in which it is applied. In this invention precision holes are punched in the belt or web member, and a dual photodiode sensor assembly is used to sense and stop the belt. The precision holes can be punched or etched in the belt to tolerances within 5 microns, such as have been used in the motion picture industry to register each frame of film in a projector. Photodiode sensors are made in different shapes and tight tolerances using, for example, photoetching techniques as used in electronics manufacturing.

The present invention relies on the tolerances of the web hole pitch instead of the tolerances of the rest of the system, and thereby reduces the overall variability of web or belt positioning. Web hole pitch should therefore be produced to match the advance movement distance desired to perform proper print stitching.

Advantageously, the present invention allows high precision performance using only low cost components. It solves a technical challenge that is extensible to all carriage based type printing systems, and enables high quality high resolution printing. It involves only low cost manufacturing and setting methods, it is a robust system that, as compared to other sensing systems, is less susceptible to heat, contamination and ambient light variations.

As can be seen, there has been provided a printer and a method for producing precise registered images are provided. The method in the printer is carried out by an included sheet transport and control assembly for moving a sheet of paper along a sheet path through a printing zone. The sheet transport and control assembly includes drive device; a moveable sheet carrying web member having a first edge and a second edge having an array of precision holes, including adjacent holes spaced a precise distance apart, formed through at least the first edge and the second edge. The sheet transport and control assembly also includes a programmable controller connected to the drive device, and a dual sensor assembly mounted along the sheet path and connected to the programmable controller for responsively generating and inputting precision hole position signals to the programmable controller. The dual sensor assembly includes a first sensor for generating a first increasing and decreasing signal, and a second sensor for generating a second increasing and decreasing signal that increases and decreases oppositely relative to the first signal. The programmable controller controls the moving device to move and stop the web member responsively to a desired value of a ratio of the first signal to the second signal, thereby ensuring precise moving and stopping of a sheet of paper on the web member through the printing zone.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A printer for producing precise registered images, the printer comprising:

(a) a printer frame including a path portion defining a sheet path, said sheet path including a printing zone;

(b) a sheet transport and control assembly mounted to said frame for moving a sheet of paper along said sheet path, said sheet transport and control assembly including:

(i) drive means for moving and stopping a sheet carrying web along said sheet path;

(ii) a sheet carrying web member having a first edge and a second edge, said web member being mounted over, and for movement along, a part of said path portion, and said web member including an array of holes formed precisely through at least one of said first edge and said second edge, and said array of precision holes comprising adjacent holes spaced a precise distance apart;

(iii) a programmable controller connected to said drive means for controlling, moving and stopping of said web member; and (iv) a dual sensor assembly connected to said programmable controller for responsively generating and inputting precision hole position signals to said programmable controller, said dual sensor assembly including a first sensor generating a first signal, and a second sensor generating a second signal, and said programmable controller calculating a signal ratio of said second signal to said first signal for moving and stopping said web member in response to a desired value of said signal ratio, thereby minimizing misregistration and other observable printed image defects in printed images.

2. The printer of claim 1, wherein said first sensor has a triangular surface area and produces a signal proportional to a portion of said surface area exposed through a hole of said array of precision holes.

3. The printer of claim 1, wherein said sensor has a triangular surface area and produces a signal proportional to a portion of said surface area exposed through a hole of said array of precision holes.

4. The printer of claim 2 wherein both said first sensor and said second sensor each have a triangular surface area and each produce a signal proportional to a portion of each said surface area exposed through a hole of said array of precision holes.

5. The printer of claim 4, wherein said first sensor produces a first signal that increases and then decreases, and said second sensor produces a second signal that increases and then decreases oppositely relative to said first signal.

* * * * *